US007204394B2

(12) United States Patent
Tackett

(10) Patent No.: US 7,204,394 B2
(45) Date of Patent: Apr. 17, 2007

(54) LIQUID CONTAINER HAVING GATE VALVE

(76) Inventor: Douglas Mac Tackett, 2933 Willowdale Ct., McKinney, TX (US) 75070

( * ) Notice: Subject to any disclaimer, the term of this patent is extended or adjusted under 35 U.S.C. 154(b) by 258 days.

(21) Appl. No.: 10/694,537

(22) Filed: Oct. 25, 2003

(65) Prior Publication Data

US 2004/0089679 A1 May 13, 2004

Related U.S. Application Data

(60) Provisional application No. 60/421,660, filed on Oct. 28, 2002.

(51) Int. Cl.
*B65D 47/00* (2006.01)

(52) U.S. Cl. ..... 222/561; 251/326; 215/322; 220/254

(58) Field of Classification Search ..... 222/471, 222/511, 513, 559, 561, 568; 251/326–329; 215/322, 78; 220/254, 41
See application file for complete search history.

(56) References Cited

U.S. PATENT DOCUMENTS

| | | | | |
|---|---|---|---|---|
| 437,865 | A | 10/1890 | Moore | |
| 639,881 | A | 12/1899 | Bailey | |
| 872,536 | A | 12/1907 | Nystrom | |
| 1,034,897 | A | 8/1912 | Fusner | |
| 1,073,528 | A * | 9/1913 | Schaab | 141/344 |
| 1,193,157 | A | 8/1916 | Krause et al. | |
| 1,481,958 | A * | 1/1924 | Fannon | 222/505 |
| 1,737,014 | A * | 11/1929 | Lindgren | 222/511 |
| 1,996,493 | A | 4/1935 | Schumacher | |
| 2,334,044 | A | 11/1943 | Swan | |
| 2,335,195 | A | 11/1943 | Packer | |
| 2,472,677 | A * | 6/1949 | Phillips | 251/176 |
| 2,490,194 | A | 12/1949 | Barclay | |
| 2,591,231 | A | 4/1952 | Boadway | |
| 2,626,089 | A * | 1/1953 | Osfar | 222/511 |
| 2,665,038 | A * | 1/1954 | Fowler | 222/561 |
| 2,717,727 | A | 9/1955 | Robb | |
| 2,759,643 | A | 8/1956 | Dahlin | |
| 2,778,547 | A | 1/1957 | Atterby | |
| 2,815,892 | A | 12/1957 | Richmond | |
| 2,944,708 | A | 7/1960 | Smeaton | |
| 3,029,003 | A | 4/1962 | Gronemeyer | |
| 3,123,259 | A | 3/1964 | Musel et al. | |
| 3,305,127 | A | 2/1967 | Baranne | |
| 3,344,958 | A * | 10/1967 | Kaanehe | 222/181.2 |
| 3,792,803 | A * | 2/1974 | Kessler | 222/511 |

(Continued)

OTHER PUBLICATIONS

Internet site address: http://www.airsource1.com/catalog.cgi?c=HARDWARE&i=RUBOIL FloTool Spill Saver Oil Spout sales website, Copy Attached.

(Continued)

*Primary Examiner*—Kevin Shaver
*Assistant Examiner*—Melvin A. Cartagena
(74) *Attorney, Agent, or Firm*—Joseph D. King

(57) ABSTRACT

A container for storing and dispensing liquids such as gasoline has a gate valve wherein the gate valve comprises a thin, substantially flat slide member optionally angled at a portion thereof. The gate valve member is slidably positioned within a similarly shaped channel formed into a surface of a reservoir (storage) portion of the container, or other area of the container.

16 Claims, 8 Drawing Sheets

U.S. PATENT DOCUMENTS 3,927,797 A 12/1975 Flider
4,331,266 A * 5/1982 Bond ..... 222/107
4,979,655 A 12/1990 Gallucci
5,000,360 A 3/1991 Lown et al.
5,056,691 A 10/1991 Tolbert
5,083,672 A * 1/1992 Lewandowski ..... 215/322
5,135,140 A 8/1992 Maguire et al.
5,297,702 A 3/1994 Crosby et al.
5,419,467 A 5/1995 Maguire et al.
5,950,665 A * 9/1999 Claus ..... 137/384.2
5,996,857 A * 12/1999 Markos ..... 222/531
6,516,973 B2 * 2/2003 Chrisman et al. ..... 222/153.14
6,619,510 B2 9/2003 Green

OTHER PUBLICATIONS

Internet site address: http://www.jackssmallengines.com/gas_can.cfm Briggs & Stratton Smart fill fuel Can sales website, Copy Attached.

* cited by examiner

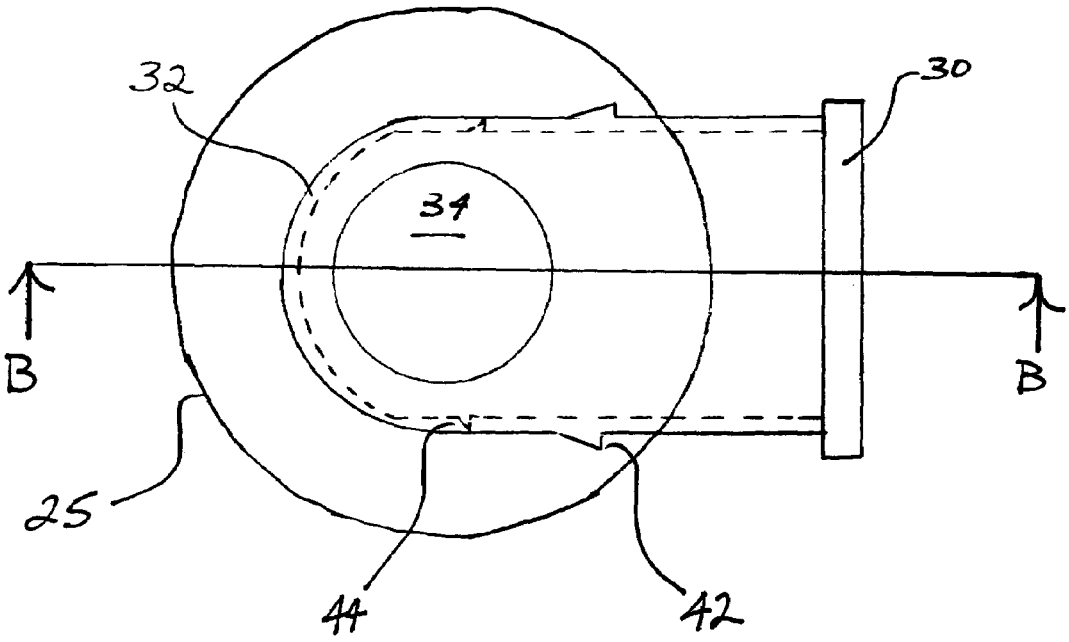
Figure 4
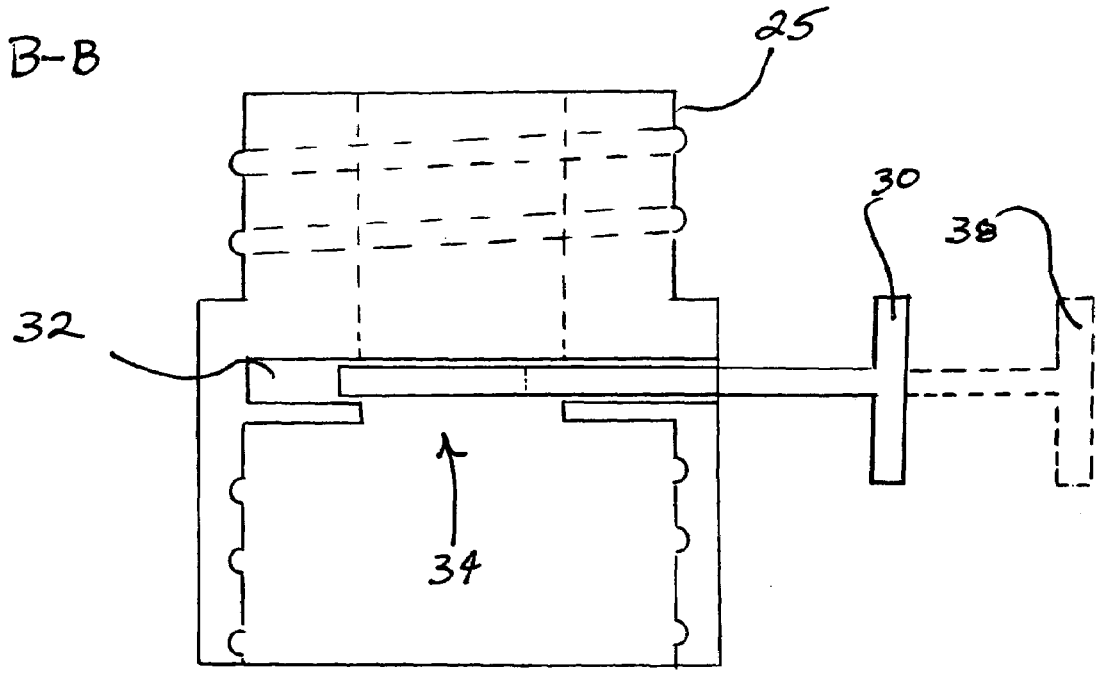

C-C

LIQUID CONTAINER HAVING GATE VALVE

This application claims the benefit of an earlier filing date under 35 U.S.C. § 119 (e) of U.S. Provisional Patent application Ser. No. 60/421,660 filed on Oct. 28, 2002, which is hereby incorporated by reference in its entirety.

TECHNICAL FIELD

The present invention generally relates to containers for storing and dispensing a liquid. More specifically, a container where a flow of liquid from a container may be selectively and reversibly interrupted at will by an operator.

BACKGROUND OF THE INVENTION

A problem often encountered when dispensing liquid from a container is that spillage of the liquid occurs. For example, pouring gasoline from a hand held container into a fuel tank mounted on a lawn mower might result in gasoline being spilled onto a hot engine causing the gas to ignite and harming an operator. This situation is not only more likely, but also particularly dangerous when the container is filled to maximum capacity.

A similar scenario exists when filling windshield washer reservoirs with cleaning fluid, the primary differences being the working area in the engine compartment is tightly constrained exacerbating the problem, and any spillage may not immediately endanger a user. However, lingering environmental effects may be incurred.

Multiple piece assemblies using intermating conical or domed structures are known forming a rotatable valve where openings in each piece are rotatably aligned to allow dispensing of fluids. This design requires a user to first rotate the valve in order to open it, reposition one's hands and then tip the container to dispense the liquid. This process encourages spillage as indicated supra.

Older designs for valve mechanisms used on gasoline containers include pivoting flapper type valves. These types of valves are made of metal, require complex hinge and actuation apparatus, and are generally unsuitable for low cost plastic injection molding manufacturing techniques.

Metal plunger type valves have been used on gasoline containers. However, these valves also require complex hinge and actuation apparatus, and are generally unsuitable for very low cost plastic injection molding manufacturing techniques used in high volume production.

Some manufacturers have placed a rotatable valve directly in line with a spout such as FloTool'S™ Spill Saver Oil Spout.

Another type of gasoline container is the Smart Fill Fuel Can® made by Briggs and Stratton where a nozzle must be rotated, the container inverted and the nozzle placed into the mouth of a gas tank. With the mouth of the gas tank supporting the full weight of the gas and container, the container is pushed downward to cause the gas to flow into the tank. This design is still complex, and expensive to produce using known plastic manufacturing techniques, including assembly of the various components. Further, pushing downward with a full gas container onto a plastic fuel tank weakly mounted on a hot lawn mower, could create a potentially hazardous situation.

BRIEF DESCRIPTION OF THE DRAWINGS

FIG. 4 shows an embodiment of the invention integrated in a neck portion of a gas container.

SUMMARY OF THE INVENTION

There is a need for a valve controlled liquid storage and dispensing container suitable for use in dispensing liquids such as gasoline, windshield washer fluid, vehicle oil, etc., which is very inexpensive to manufacture using processes including plastic injection molding. There is also a need for a container having a valve assembly that may be actuated with the same hand that is simultaneously supporting a portion of the container, while the container is orientated in a pouring position.

A combination of a container (e.g. gasoline can) and a gate valve wherein the gate valve comprises a substantially flat member angled at a portion thereof. The gate valve member is slidably engagable within a similarly shaped channel formed into a surface of a container proximate to a neck portion of the container. The channel comprises first and second orifices in alignment and formed in opposing surfaces at a first end of the channel positioned beneath a neck portion. The gate valve member is slidably operative to a first position where a flow of liquid is blocked from a reservoir portion of the container to the neck portion and subsequently out of the container. The gate valve member is slidably moveable to a plurality of second positions whereas a flow of fluid may be varied from a mostly restricted flow, to a completely non-restricted flow commensurate with a position of the gate valve member. The gate valve member and/or the channel may be of a material that is resiliently deformable so as to provide a resilient interference fit between the gate valve member and the first and second orifices in the channel. One alternate embodiment of the invention is a gate valve mechanism, either spring biased or unbiased, fitted wholly into a portion of a threaded neck member of the container in contrast to the first embodiment wherein the gate valve mechanism is fitted into a surface of the container. A second alternate embodiment comprises a gate valve mechanism, either biased or unbiased (e.g. a spring), fitted wholly into a portion of a removable coupling or spout that may or may not have universal threads and/or diameter to fit any other gas can or other container.

DETAILED DESCRIPTION OF THE INVENTION

Figure 1:
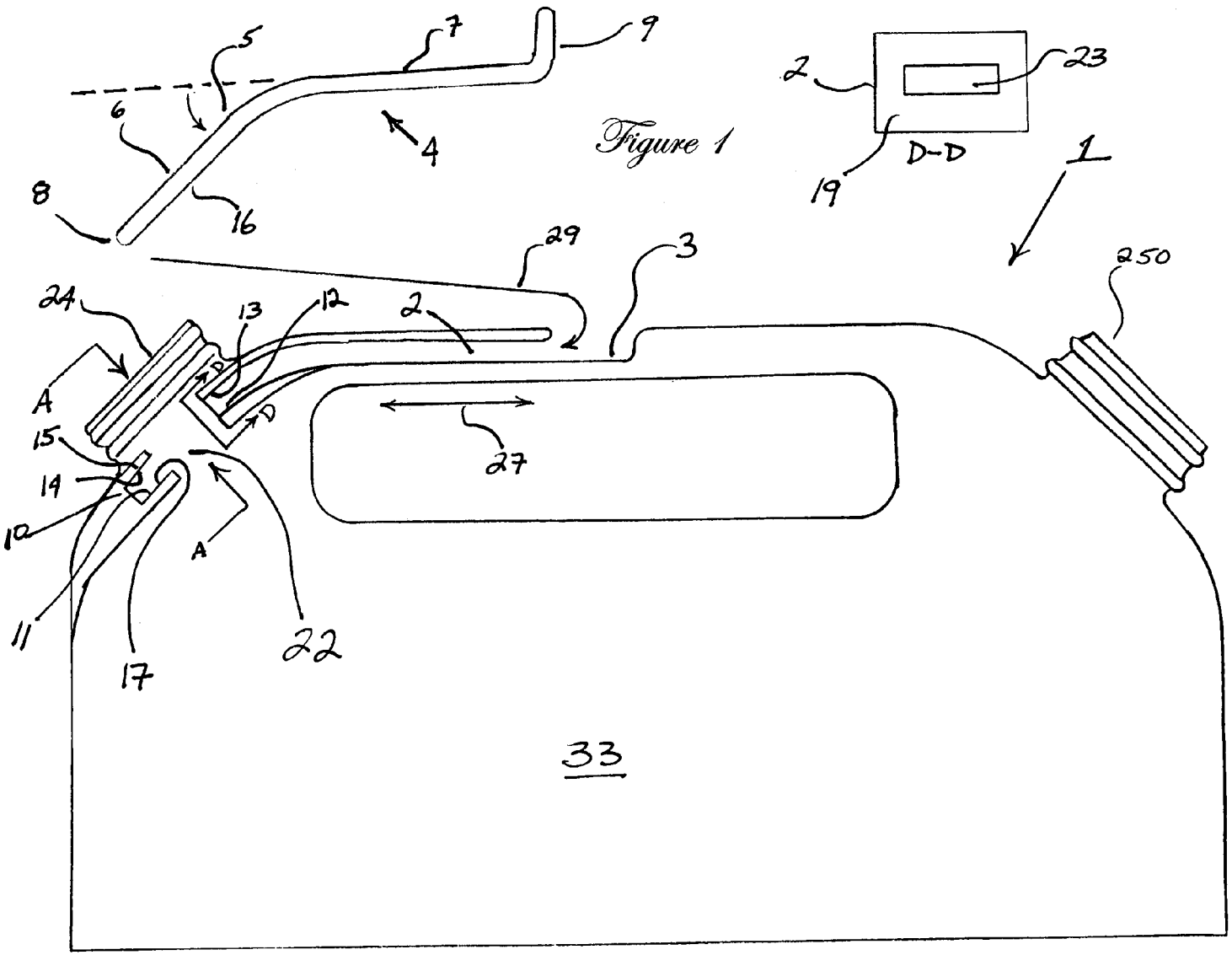
FIG. 1 is a side view of one embodiment of the invention described herein.

A container 1 in accordance with embodiments of the invention is shown in FIG. 1 having reservoir 33 for storing liquids, and a threaded neck portion 24 having an opening (not shown) for dispensing liquids such as gasoline. A substantially flat gate valve member 4 is slideably disposed within a portion of a channel 2 formed into a surface 3 of container 1 as shown by arrow 29. In an alternate embodiment, optionally thin gate valve member 4, has a portion thereof 5 acutely angled with respect to the remaining portion 7. Channel 2 has a shape that generally follows the contour of the shape of the container as shown in FIG. 1. A gate valve is a type of valve that incorporates a sliding gate to block fluid flow, where the direction of gate movement is substantially perpendicular to a direction of fluid flow. A gate valve can block fluid flowing in either direction. In embodiments of the invention herein, the use of a gate valve also prevents moisture, rain, pests or other contaminants from entering the container.

Figure 2:
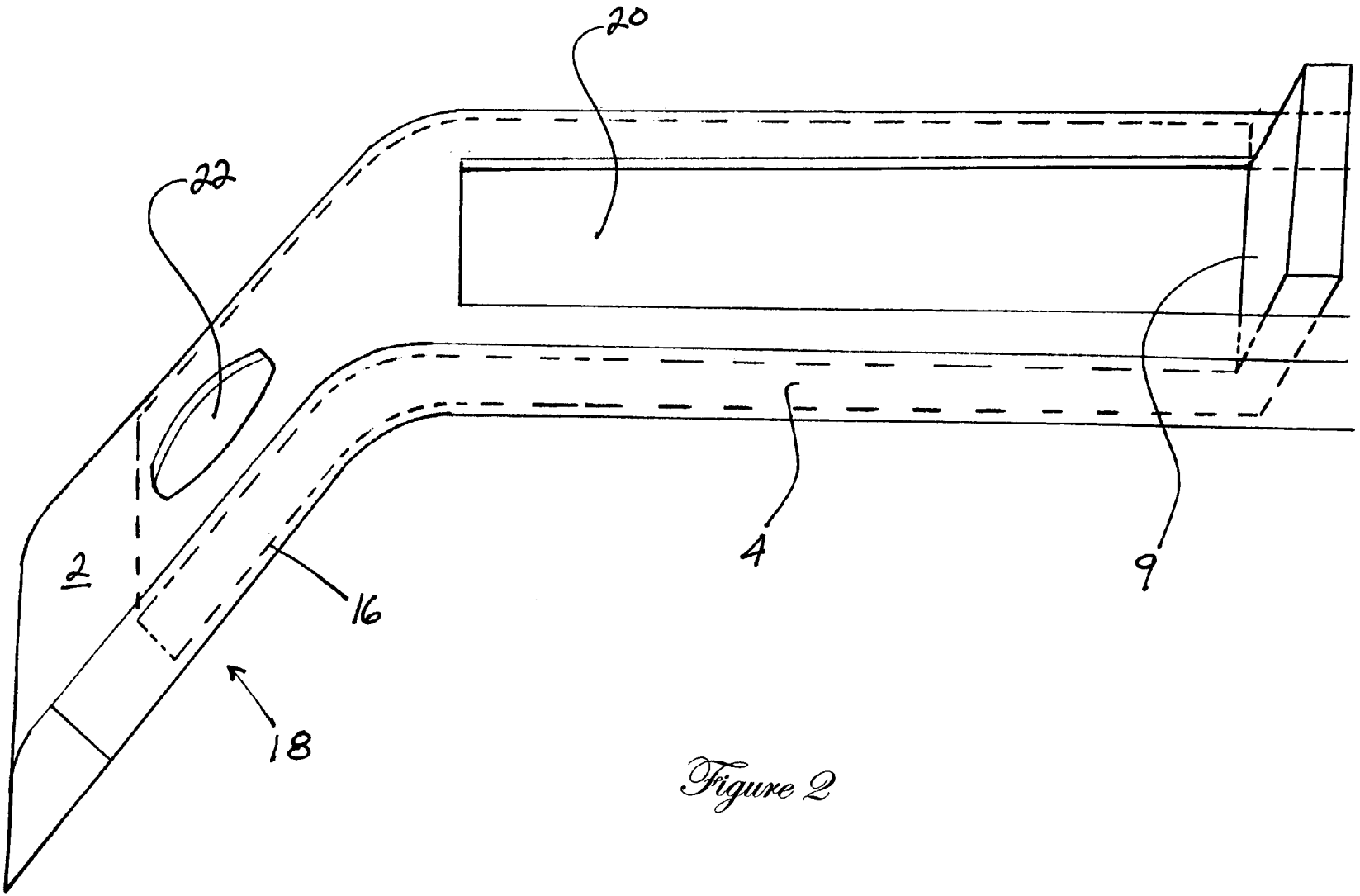
FIG. 2 is a perspective, partial view of the gate valve member disposed in the channel of FIG. 1.
Figure 3:
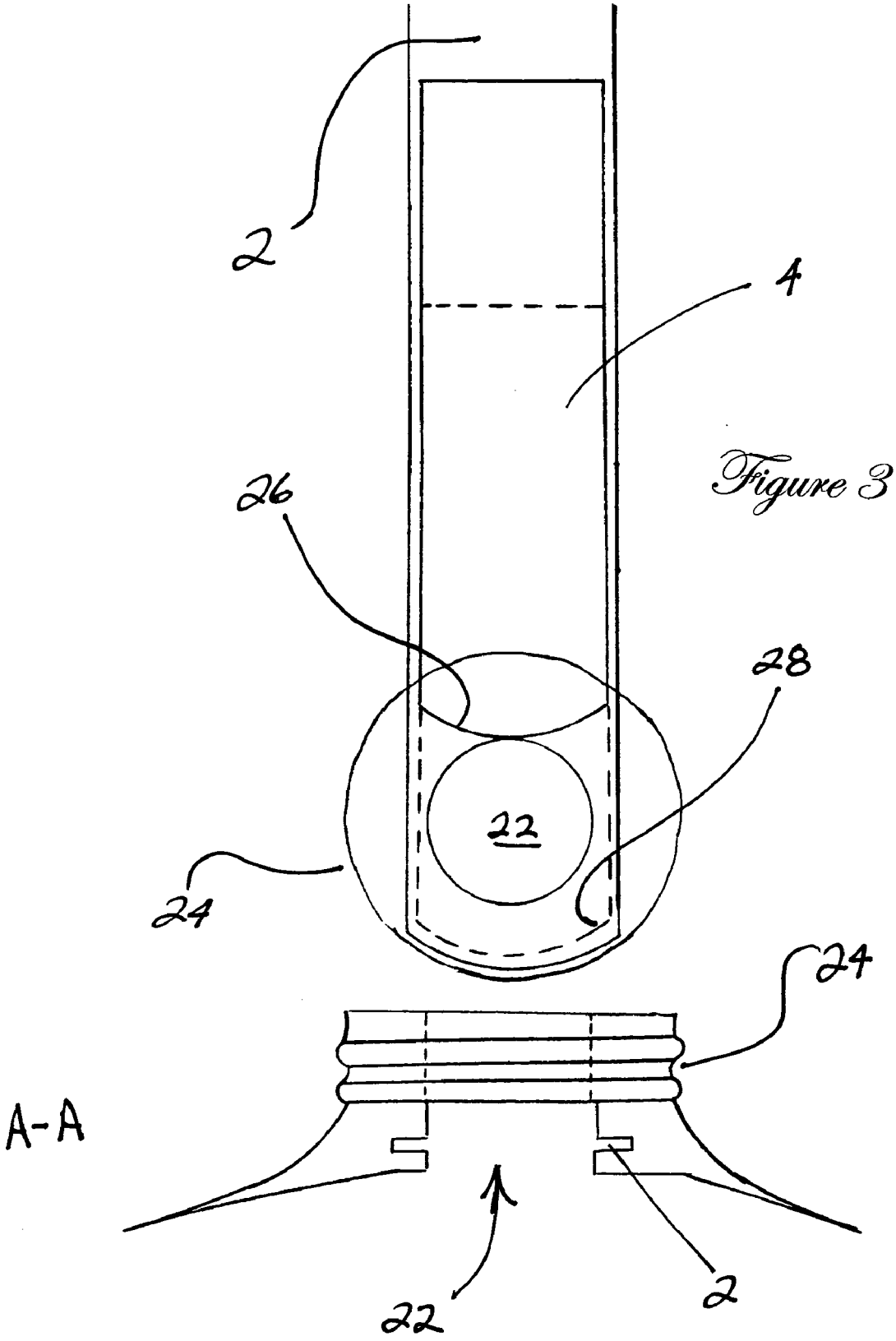
FIG. 3 is an end and top view of view A—A of FIG. 1.

Gate valve member 4, and optionally container 1 may be made of resiliently deformable material such as plastic (including, but not limited to HDPE, LDPE, PVC, Delrin™ etc.). Channel 2 has sealing surfaces 13 and 14 formed into face 15. Sealing surfaces 11 and 12 are formed in opposite face 17 of channel 2. Gate valve member 4 has surfaces 6 and 16 disposed on acutely angled portion 5 that are reverseably mateable with complementary sealing surfaces 13, 14 and 11, 12 respectively, that are formed in opposing faces of channel 2. Fluid leakage is prevented by pressure engagement between surfaces 6 and 16 of gate valve member 4 and sealing surfaces 11,12,13,14 via a resilient interference fit. End 8 of gate valve 4 may abut surface 10 of channel 2 forming a mechanical stop. An opening 22 formed through an end of channel 2 is positioned under threaded neck portion 24. When gate valve member 4 is slideably moved in a direction parallel to channel 2 as shown by the arrow 27 in FIG. 1, end 8 of gate valve member 4 traverses across opening 22 in channel 2 thereby allowing a stream of fluid to flow from reservoir 33, through opening 22 and out of threaded neck portion 24. Gate valve member may be moved incrementally in order to achieve varying flow rates ranging from a mere trickle, to maximum flow when opening 22 is fully exposed. Further, gate valve member 4 may be operated with one hand after container 1 is inverted and neck 24 positioned over or in a second container such as a gas tank on a lawn mower. Container 1 may or may not be operated with a spout (not shown) attached to threaded neck portion 24 as some embodiments of the invention are integral only to the body portion of the container such as shown in FIGS. 1–3. In alternate embodiments, gate valve member 4 is spring biased to a normally closed position providing a fail safe mechanism.

An alternate embodiment of channel 2 and gate valve member 4 uses a sealing slot 23 formed in a wall 19 formed transversely across channel 2 as shown in view D—D. Gate valve member 4 slides through sealing slot 23 thereby precluding fluid leakage out of channel 2.

Gate valve member 4 (which may be very thin) is shown disposed in channel 2 of the partial perspective view 18 of FIG. 2. Opening 22 formed in channel 2 is shown as blocked by gate valve member 4. Slot 20 may be formed in channel 2 to allow a handle portion 9 to move back and forth within channel 2.

FIG. 3 shows an end view section A—A of channel 2 in FIG. 1. Channel 2 is shown positioned under threaded neck portion 24 for receiving gate valve member 4 without interfering with a threaded mating cap or spout (not shown). FIG. 3 also shows a top view of section A—A. Gate valve member 4 is shown in two positions: fully closed by the dotted lines 28 thereby blocking a liquid flow, and fully open as shown by solid lines 26 thereby allowing a maximum flow of liquid. Though only two positions are shown in FIG. 3, it is fully understood not to be a limitation of any of the embodiments of the invention herein. Many incremental positions of gate valve member 4 are possible using embodiments of the invention herein in order to vary a flow of liquid from a mere trickle, to maximum flow as dictated by a diameter of opening 22. The direction of actuation of gate valve member 4 may be generally perpendicular relative to a vertical axis (not shown) emanating out from threaded neck portion 24 in FIG. 1.

An alternate embodiment of the invention is shown in FIG. 4. A solid flat gate valve member 30 is slideably disposed in channel 32 formed into a portion of a threaded male-female coupling 25. Gate valve member 30 is actuated in bi-directional fashion perpendicular to a path formed by a flow of liquid progressing from the female threads to the male threads. Gate valve member 30 may be captively retained in channel 32 via retaining ears or tabs 44 and complementary locking notches 42 or equivalent. This captive retaining action prevents gate valve member 30 from being completely withdrawn out of channel 32 thereby precluding leaks, evaporation of the contents, or spillage. View B—B shows a section of the top view along lines B—B. Sealing of gate valve member 30 to the coupling 25, and operation thereof is substantially similar to the embodiments described supra and will not be repeated here. A feature of embodiments of coupling 25 is that the gate valve member 30, ergo the entire gate valve, is wholly contained within the coupling 25 itself. No part of the gate valve is integral (an essential part thereof) to the body of a container, and therefore may be manufactured separately from liquid containers. Consequently, the gate valve may be purchased and added to existing containers.

Figure 5:
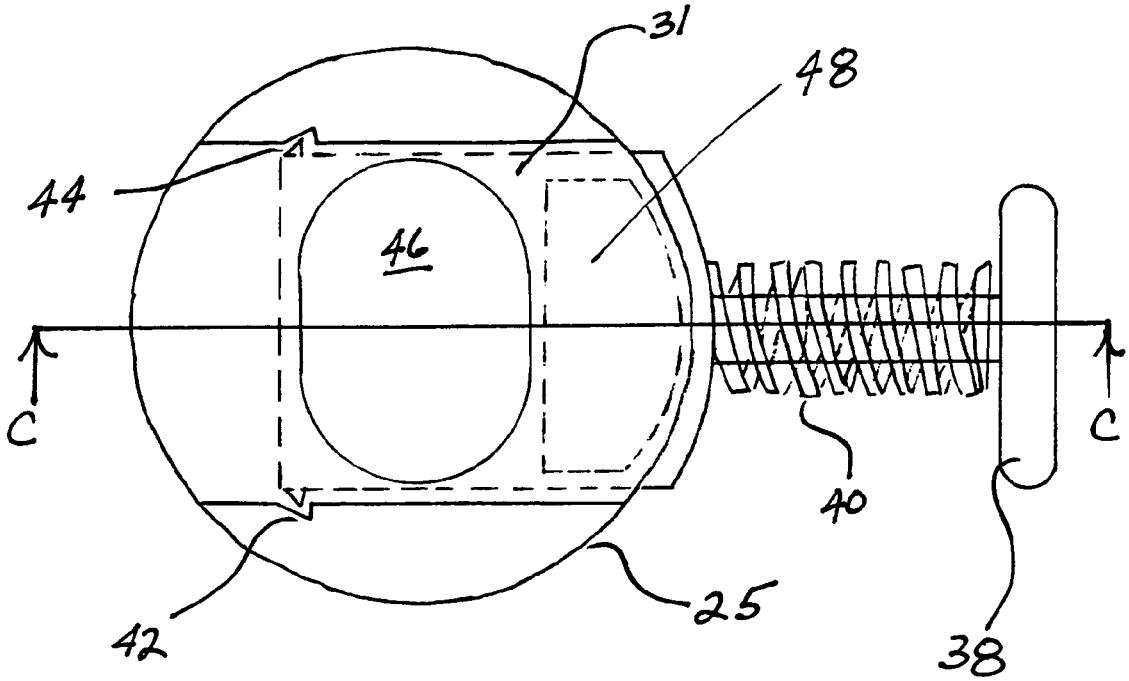
FIG. 5 shows an alternate embodiment of the invention of FIG. 4.
Figure 5:
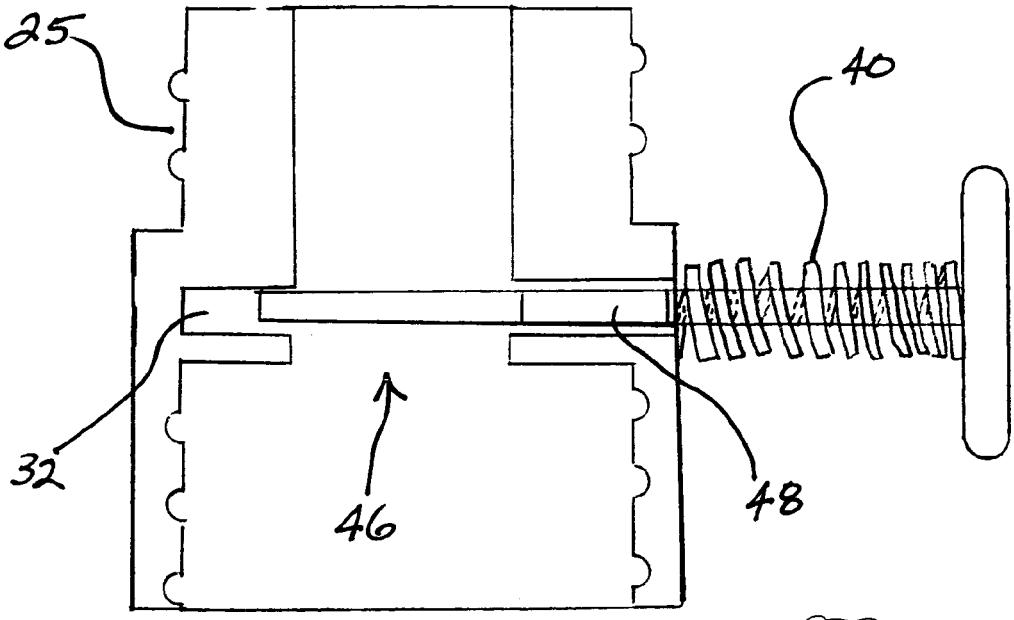

Another alternate embodiment of the invention is shown in FIG. 5. A flat gate valve member 31 having an aperture or hole 48 is slideably disposed in channel 32 formed into a portion of a threaded male-female coupling 25. Gate valve member 31 is spring biased (a concave washer, a cantilevered lever etc. may also be used to accomplish biasing) in a fail-safe manner to a normally closed (fluid flow blocked) position. This fail-safe gate valve prevents spillage in the event a container having an embodiment of the invention is accidentally dropped while dispensing liquids such as gasoline into a lawnmower. When an operator desires to cause a flow of liquid through the coupling 25, one need only push on thumb tab 38 compressing spring 40 thereby causing hole 48 to be at least partially aligned with opening 46 establishing liquid flow. As more force is exerted onto thumb tab 38, the higher a flow rate is obtained because a larger portion of hole 48 is aligned with opening 46.

Gate valve member 31 is actuated in bi-directional fashion perpendicular to a path formed by a flow of liquid progressing from the female threads to the male threads. Gate valve member 31 may be captively retained in channel 32 via retaining ears or tabs 44 and complementary locking notches 42. This captive retaining action prevents gate valve member 31 from being completely withdrawn out of channel 32 thereby precluding leaks, evaporation of the contents, or spillage. View C—C shows a section of the top view along lines C—C. Sealing of gate valve member 31 to the coupling 25, and operation thereof is substantially similar to the embodiments described supra and will not be repeated here. A feature of embodiments of coupling 25 is that the gate valve member 31, ergo the entire gate valve, is wholly contained within the coupling 25 itself. No part of the gate valve is integral (an essential part thereof) to the body of a container, and therefore may be manufactured separately from liquid containers. Consequently, the gate valve may also be purchased and added to existing containers.

Figure 6:
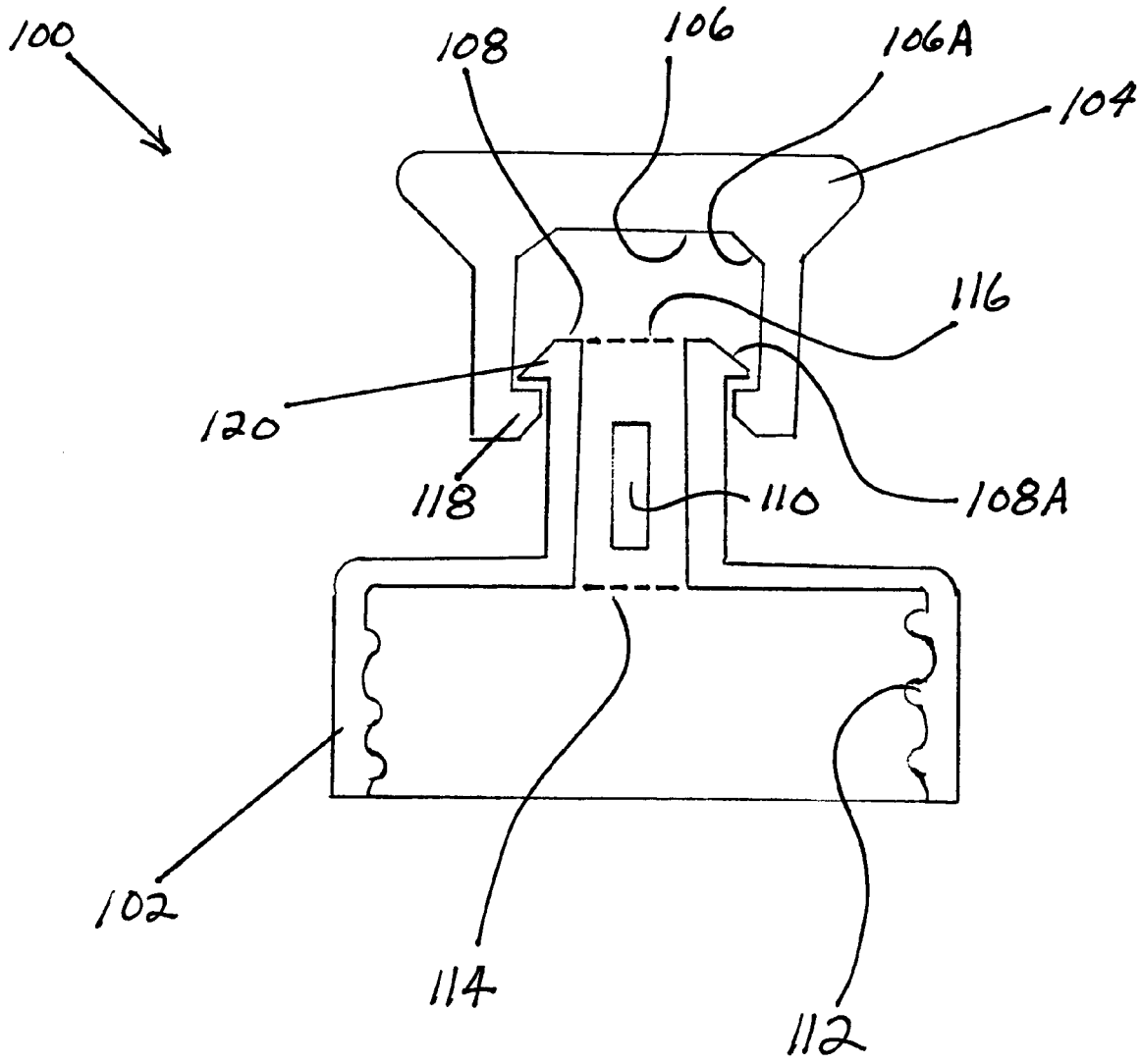
FIG. 6 shows an embodiment of an inventive vent assembly for a container in an open "vented position".

FIG. 6 shows one embodiment of an inventive vent cap assembly 100 for use with container 1 shown in FIG. 1. Vent cap 100 is threaded onto second threaded neck portion 50 shown in FIG. 1 via threads 112 formed into body 102.

Figure 7:
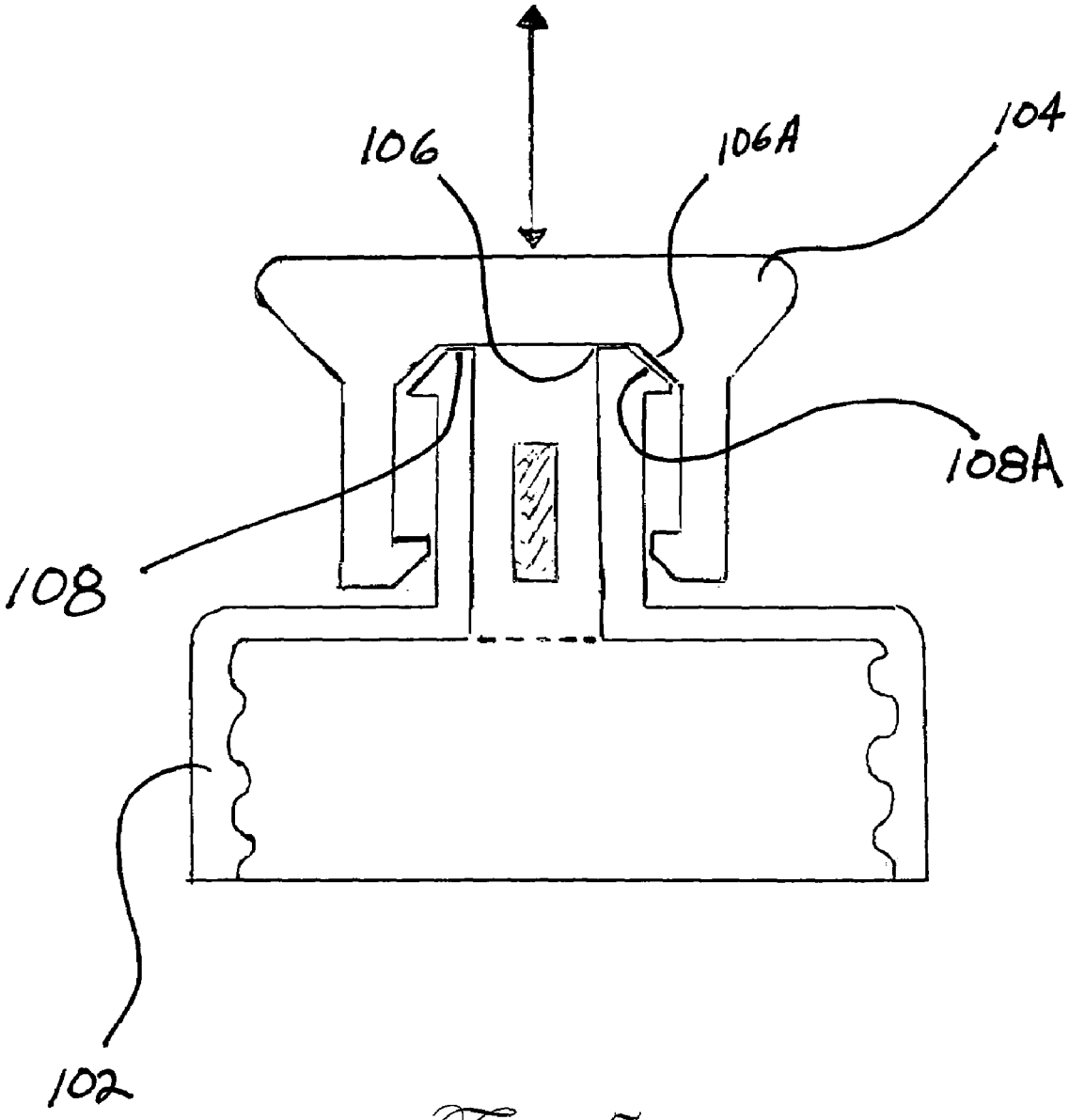
FIG. 7 shows an embodiment of an inventive vent assembly for a container in a closed "sealed position".

Handle 104 is pulled upwards thereby breaking a seal formed by surfaces 106 and 108 allowing gas pressure to equalize between reservoir 33 and ambient atmosphere via openings 114 and 116. Mateable surfaces 106A and 108A may also be used to provide additional sealing as required. When the gas pressure between container 1 and ambient atmosphere is equal, a continual flow of liquid may be established from container 1 as is known in the art. FIG. 7 shows vent cap 100 in a closed, sealed configuration. Handle 104 is pushed downward causing surfaces 106 and 108 to be pressed together thereby preventing stored liquid from spilling from container 1. Handle 104 may become locked in place when moved to the open or closed positions. Further handle 104 is captively retained to body 102 via retaining ears or tabs 118 and 120.

It is understood that variations of embodiments of the inventions herein are possible that are still within the bounds of embodiments of the inventions. For example, a spout molded into container 33 may replace the male threads shown in FIGS. 1, 4, and 5. Further, spring 40 may be disposed inside channel 32 to allow either push or pull operation (hole 48 is repositioned accordingly), though only push actuation is described. Spring 40 may also be deployed on the container and valve system of FIG. 1 similar to FIG. 5.

Further, although the gate valve/couplings of FIGS. 4 and 5 are shown as reversibly attachable to a container, neck member 24 of FIG. 1 may be modified such as to incorporate the embodiments of FIGS. 4 & 5 into container 1 as a single piece construction (except gate valve member 4,48 and/or spring 40).

Further, embodiments of the gate valve shown in FIGS. 4 and/or 5 may be incorporated into a spout that is either reversibly mateable to a container, or is a permanent part of a container.

Figure 8:
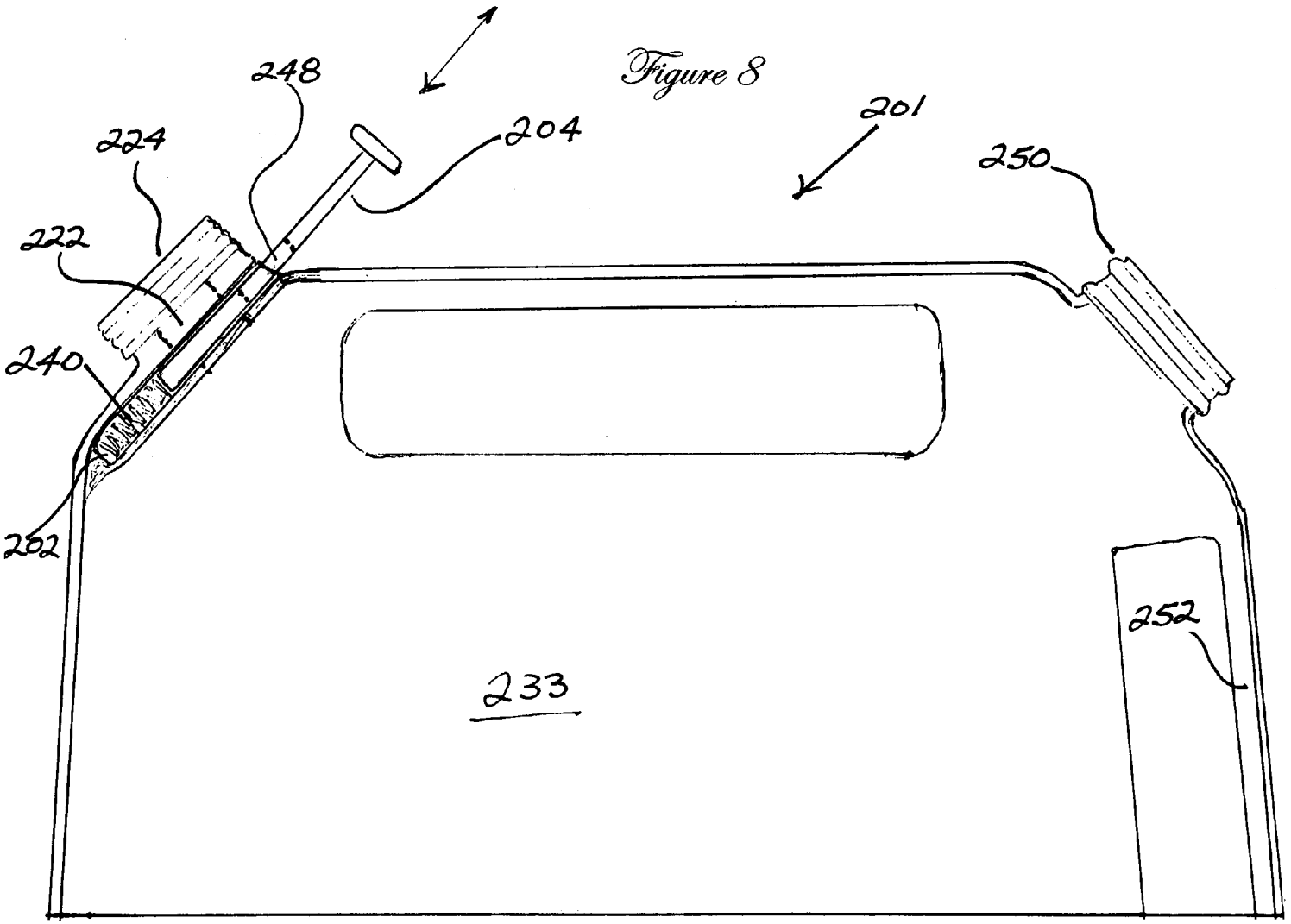
FIG. 8 shows an alternate embodiment of the invention described in FIG. 1.

FIG. 8 shows another embodiment of the invention herein. Gate valve 204 is disposed in a channel 202 formed in a corner of container 201. Internal spring 240 outwardly biases gate valve 204 to a normally closed position where first opening 248 formed into gate valve 204 is misaligned with second opening 222 formed through channel 202 and first neck portion 224 which may be thread to accept a spout. The valve is closed when openings 248 and 222 are misaligned. An operator moves gate valve 204 inward causing first opening 248 to become at least partially aligned with second opening 222 thereby allowing a flow of liquid to be established from reservoir 233 through second opening 248/222 and out of first neck portion 224. Container 201 has a second neck portion 250 that may accept a vent cap 100 described above.

Container 210 may be filled through second neck portion 250 thereby allowing opening 222 in first neck portion 224 and/or opening 248 to be a smaller diameter than would be necessary if container 201 was to be filled through first neck portion 224. A smaller diameter opening allows for more precise control of a fluid stream when dispensing liquids. Optionally, handle 252 may be formed into a side or bottom surface of container 201 to facilitate handling of container 201 when tilted or inverted.

In accordance with the provisions of the patent statutes and jurisprudence, exemplary configurations and combination of elements herein as described above are considered to represent preferred embodiments of the invention. However, it should be noted that the invention can be practiced otherwise than as specifically illustrated and described without departing from its spirit or scope.

I claim:

1. A container for dispensing fluid comprising;

a channel formed into a surface of said container and having a shape that generally follows a contour of said container, said channel positioned proximate to a threaded neck member having an orifice for dispensing a liquid, said channel having first and second openings formed in opposite surfaces thereof at a first end of said channel;

a one piece a gate valve member slideably positioned in said channel wherein only a first end of said gate valve member is acutely angled with respect to remaining portion of said gate valve, said acute angle formed in a first direction;

wherein said gate valve member further comprises a handle formed at a second end of said gate valve member said handle formed in a direction opposite said first direction; and wherein said gate valve member is composed of a resiliently deformable material operative to provide an interference fit for providing a seal between said gate valve member and said channel.

2. The container of claim 1 wherein said channel has a shape that generally follows a contour of said container.

3. The container of claim 1 further comprising captive retaining means operative to prevent said gate valve member from being completely withdrawn from said channel.

4. The container of claim 3 further comprising retaining tabs located on said gate valve member, said tabs reversibly mateable with complementary locking notches formed into said channel.

5. The container of claim 1 further comprising fail safe biasing means operative to position said gate valve member in a normally closed position thereby blocking a flow of fluid until said gate valve member is intentionally actuated by an operator.

6. The container of claim 5 wherein said biasing means comprises a spring.

7. The gate valve assembly of claim 6 further comprising a hole formed into said gate valve member.

8. The container of claim 1 wherein a complete valve and container system consists of only two pieces: said container, and said gate valve member.

9. The container of claim 1 wherein said first end of said gate valve member being acutely angled with respect to a remaining portion of said gate valve is positioned within said channel.

10. A two piece container and valve system for dispensing fluid, said system consisting of said container, and said valve, said system comprising;

a channel formed into a surface of a reservoir portion of said container, and having a shape that generally follows a contour of said container, a portion of said channel positioned under a threaded neck member, said channel having first and second openings formed in opposite surfaces thereof at a first end of said channel;

a one piece generally flat gate valve member slideably positioned in said channel, said one piece gate valve member having only a first end acutely angled with respect to a remaining portion of said gate valve;

a spring positioned in said channel between said generally flat gate valve member and said first end of said channel, said spring operative to positioned said gate valve member in a normally closed position thereby blocking a flow of fluid until said gate member is intentionally actuated by an operator;

wherein said gate valve member is composed of a resiliently deformable material to provide an interference fit for sealing said gate valve member within said channel; and wherein said first and said second openings are positioned under said threaded neck member.

11. The container of claim 10, wherein a direction of movement of said gate valve member is perpendicular to a direction of a flow of said liquid.

12. The container of claim 10 further comprising captive biasing means operative to 1) prevent said gate valve member from being completely withdrawn from said channel and 2) provide fail safe biasing means operative to position said gate valve member in a normally closed position thereby blocking a flow of fluid until said gate valve member is intentionally actuated by an operator.

13. A gate valve assembly reversibly attachable to a top portion of a container for dispensing fluid, said gate valve assembly comprising;

a coupling having means for reversibly attaching said coupling to said container;

a channel formed into said coupling, said channel having first and second openings formed in opposite surfaces thereof;

a gate valve member slideably positioned in said channel;

wherein said gate valve member has retaining tabs protruding from opposing side surfaces of said gate valve member, said retaining tabs positioned entirely within said channel;

wherein said retaining tabs are entirely slidable within said channel;

wherein said gate valve member is composed of a resiliently deformable material operative to provide an interference fit for providing a seal between said gate valve member and said channel; and wherein said means for reversibly attaching said coupling to said container is with a first set of threads, and further comprising a second set of threads formed on or in an end of said gate valve assembly opposite said first set of threads.

14. The gate valve assembly of claim 13 further comprising a biasing means operative to position said gate valve member in a normally closed position thereby blocking a flow of fluid until said gate valve member is intentionally actuated by an operator.

15. The gate valve assembly of claim 14 wherein said biasing means is a spring positioned inside said channel.

16. The gate valve assembly of claim 13 further comprising a spout formed in or on one end of said gate valve assembly.

* * * * *